US006161742A

United States Patent [19]

Kiser

[11] Patent Number: 6,161,742

[45] Date of Patent: Dec. 19, 2000

[54] PAGER HOLDER SYSTEM

[76] Inventor: Alen D. Kiser, 9101 E. 27th St., Tuscon, Ariz. 85710

[21] Appl. No.: 09/253,928

[22] Filed: Feb. 22, 1999

[51] Int. Cl.[7] ..... A45F 5/00

[52] U.S. Cl. ..... 224/251; 224/674; 224/904

[58] Field of Search ..... 224/930, 251, 224/674, 675, 904, 249; D3/218, 228

[56] References Cited

U.S. PATENT DOCUMENTS

| | | | |
|---|---|---|---|
| D. 280,863 | 10/1985 | Leath | D3/218 |
| 298,759 | 5/1884 | Kennard . | |
| 710,236 | 9/1902 | Audley | 224/251 |
| 2,618,419 | 11/1952 | Vanish . | |
| 3,533,540 | 10/1970 | Carinci | 224/674 |
| 3,637,120 | 1/1972 | Clay | 224/251 |
| 4,106,679 | 8/1978 | Hillinger . | |
| 4,757,927 | 7/1988 | Rutty | 224/904 X |
| 4,790,461 | 12/1988 | Stover . | |
| 4,955,518 | 9/1990 | Parsons et al. | 224/251 X |
| 5,052,603 | 10/1991 | Spina | 224/674 X |
| 5,385,282 | 1/1995 | Chen . | |
| 5,477,999 | 12/1995 | Blankenship, Jr | 224/674 X |
| 5,775,558 | 7/1998 | Montalbano | 224/930 |

FOREIGN PATENT DOCUMENTS

| | | |
|---|---|---|
| 139928 | 8/1984 | European Pat. Off. . |

*Primary Examiner*—Stephen K. Cronin
*Assistant Examiner*—Robin A. Hylton

[57] ABSTRACT

A pager holder including a generally rectangular primary strip of a durable material with a central fold line at the upper extent to provide an exterior portion and an interior portion of substantially the same length. The lower extent of the exterior portion and the lower extent of the interior portion are sewn together by stitching along a rectangular periphery for the majority of their extents but sufficient to retain an unstitched loop in the upper region for the passage of a belt therethrough. A supplemental patch of supplemental material is provided. The supplemental patch of material has a width essentially equal to the width of the primary strip. The supplemental patch is sewn by stitching along its vertical edges coextensive with the vertical edges of the primary strip through common threads to form a vertical loop for the receipt of a pager clip and an open upper edge and lower edge.

1 Claim, 2 Drawing Sheets

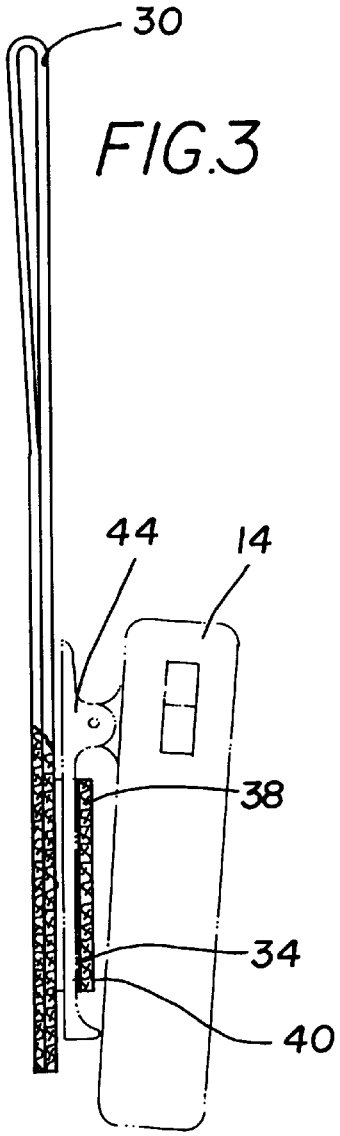
FIG.3
FIG.4
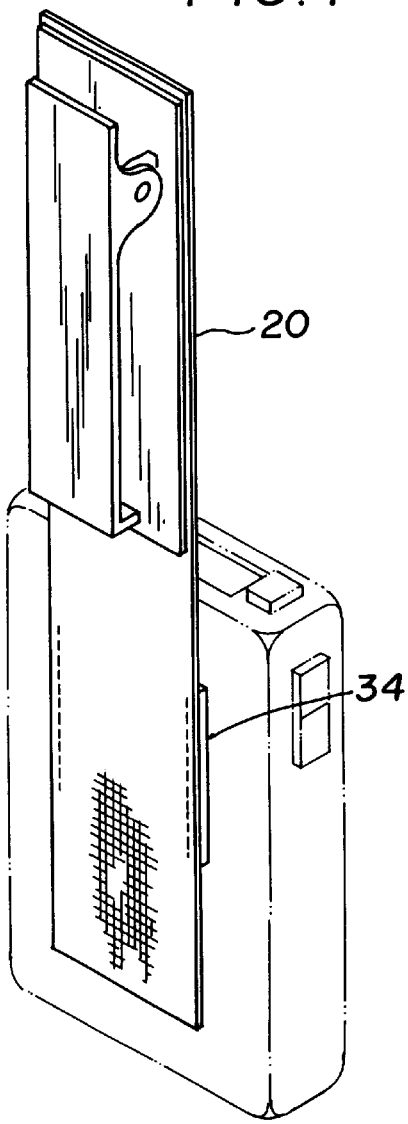

PAGER HOLDER SYSTEM

BACKGROUND OF THE INVENTION

1. Field of the Invention

The present invention relates to a new and improved pager holder system and, more particularly, pertains to conveniently supporting a pager from a region suspended from a wearer's belt.

2. Description of the Prior Art

The use of holders of known designs and configurations is known in the prior art. More specifically, holders of known designs and configurations heretofore devised and utilized for the purpose of supporting pagers through known methods and apparatuses are known to consist basically of familiar, expected, and obvious structural configurations, notwithstanding the myriad of designs encompassed by the crowded prior art which has been developed for the fulfillment of countless objectives and requirements.

The prior art discloses a large number of holders of known designs and configurations. By way of example, U.S. Pat. No. 4,790,461 to Stover discloses an Implement Holder.

U.S. Pat. No. 2,618,419 to Vanish discloses a Hammer Holster.

European Pat. Application No. 139,928 to Kochler discloses a Holder.

U.S. patent application No. 298,759 to NEC Corporation discloses a Housing and Holder Assembly for a Portable Communication Apparatus.

U.S. Pat. No. 5,385,282 to Chen discloses a Beeper Holder.

Lastly, U.S. Pat. No. 4,106,679 to Hillinger discloses a Tool Holder.

In this respect, the pager holder system according to the present invention substantially departs from the conventional concepts and designs of the prior art, and in doing so provides an apparatus primarily developed for the purpose of conveniently supporting a pager from a region suspended from a wearer's belt.

Therefore, it can be appreciated that there exists a continuing need for a new and improved pager holder system which can be used for conveniently supporting a pager from a region suspended from a wearer's belt. In this regard, the present invention substantially fulfills this need.

SUMMARY OF THE INVENTION

In view of the foregoing disadvantages inherent in the known types of holders of known designs and configurations now present in the prior art, the present invention provides a new and improved pager holder system. As such, the general purpose of the present invention, which will be described subsequently in greater detail, is to provide a new and improved pager holder system and methods which have all the advantages of the prior art and none of the disadvantages.

To attain this, the present invention essentially comprises a new and improved pager holder system for conveniently supporting a pager from a region suspended from a wearer's belt. The system includes a generally rectangular primary strip of a durable material. The primary strip has a central fold line at the upper extent to provide an exterior portion and an interior portion of substantially the same length. The lower extent of the exterior portion and the lower extent of the interior portion are sewn together by stitching along a rectangular periphery for the majority of their extents but sufficient to retain an unstitched loop in the upper region for the passage of a belt therethrough. The primary strip has a width of between about 1 and ¾ inches and 2 inches and a total length of between about 14 inches to 18 inches. Also included in the system is a supplemental patch of supplemental material having a width essentially equal to the width of the primary strip, i.e., and a width of between about 1 and ¾ inches and 2 inches with a height of about one and ½ inches to about one and ¾ inches. The supplemental patch is sewn by stitching along its vertical edges coextensive with the vertical edges of the primary strip through common threads to form a vertical loop for the receipt of a pager clip and an open upper edge and lower edge. A pager is supported by the device with a spring urged clip. The clip has an arm depending downwardly through the open upper edge formed between the patch and the primary strip.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved pager holder system which has all the advantages of the prior art holders of known designs and configurations and none of the disadvantages.

It is another object of the present invention to provide a new and improved pager holder system which may be easily and efficiently manufactured and marketed.

It is a further object of the present invention to provide a new and improved pager holder system which is of a durable and reliable construction.

An even further object of the present invention is to provide a new and improved pager holder system which is susceptible of a low cost of manufacture with regard to both materials and labor, and which accordingly is then susceptible of low prices of sale to the consuming public, thereby making such a pager holder system economically available to the buying public.

Even still another object of the present invention is to conveniently support a pager from a region suspended from a wearer's belt.

Lastly, it is an object of the present invention to provide a pager holder including a generally rectangular primary strip of a durable material with a central fold line at the upper extent to provide an exterior portion and an interior portion of substantially the same length. The lower extent of the exterior portion and the lower extent of the interior portion are sewn together by stitching along a rectangular periphery for the majority of their extents but sufficient to retain an unstitched loop in the upper region for the passage of a belt therethrough. A supplemental patch of supplemental material is provided. The supplemental patch of material has a width essentially equal to the width of the primary strip. The supplemental patch is sewn by stitching along its vertical edges coextensive with the vertical edges of the primary strip through common threads to form a vertical loop for the receipt of a pager clip and an open upper edge and lower edge.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a side elevational view of the system shown in FIG. 1.

FIG. 4 is a perspective illustration of the pager shown in FIGS. 3 and 4 taken from the rear thereof.

The same reference numerals refer to the same parts throughout the various Figures.

DESCRIPTION OF THE PREFERRED EMBODIMENT

Figure 1:
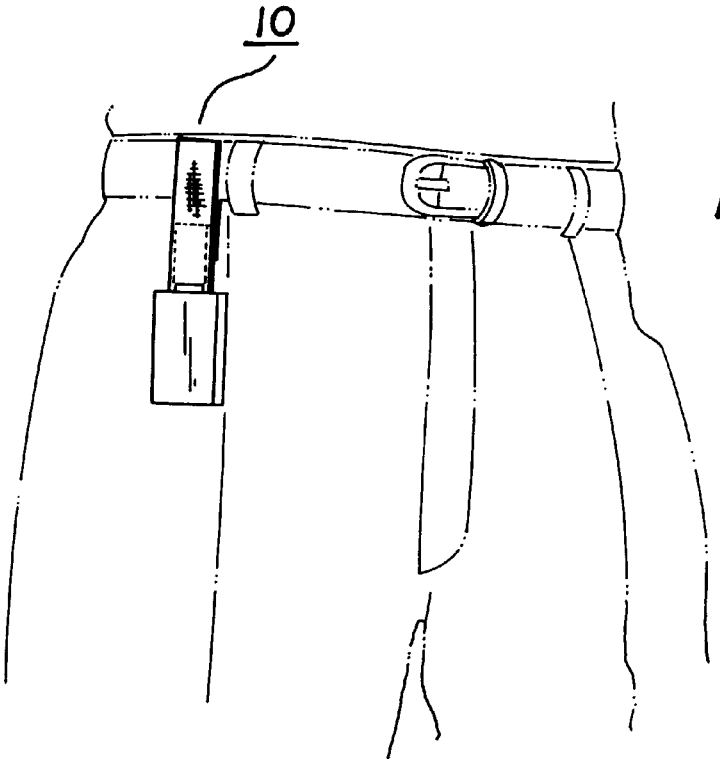
FIG. 1 is a perspective illustration of the preferred embodiment of the pager holder system constructed in accordance with the principles of the present invention.
Figure 2:
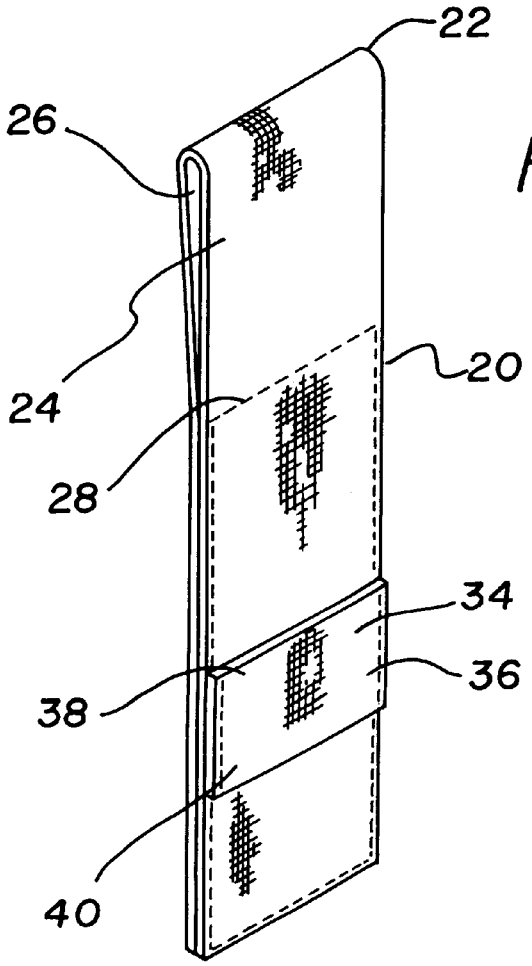
FIG. 2 is an enlarged perspective view of the holder shown in FIG. 1.

With reference now to the drawings, and in particular to FIGS. 1 through 4 thereof, the preferred embodiment of the new and improved pager holder system embodying the principles and concepts of the present invention and generally designated by the reference numeral 10 will be described.

The present invention, the new and improved pager holder system, is a system 10 comprised of a plurality of components. Such components, in their broadest context, include a primary strip, a supplemental patch, and a pager. Each of the individual components is specifically configured and correlated one with respect to the other so as to attain the desired objectives.

The present invention as described herein is a new and improved pager holder system 10 for conveniently supporting a pager 14 from a region suspended from a wearer's belt 16.

The system comprises, in combination a generally rectangular primary strip 20 of a durable material. The primary strip has a central fold line 22 at the upper extent to provide an exterior portion 24 and an interior portion 26 of substantially the same length. The lower extent of the exterior portion and the lower extent of the interior portion are sewn together by stitching 28 along a rectangular periphery for the majority of their extents but sufficient to retain an unstitched loop 30 in the upper region for the passage of a belt therethrough. The primary strip has a width of between about 1 and ¾ inches and 2 inches and a total length of between about 14 inches to 18 inches.

Also included in the system is a supplemental patch 34 of supplemental material having a width essentially equal to the width of the primary strip, i.e., and a width of between about 1 and ¾ inches and 2 inches with a height of about one and ½ inches to about one and ¾ inches. The supplemental patch is sewn by stitching 36 along its vertical edges coextensive with the vertical edges of the primary strip through common threads to form a vertical loop for the receipt of a pager clip and an open upper edge 38 and lower edge 40.

A pager 14 is supported by the device with a spring urged clip 44. The clip has an arm depending downwardly through the open upper edge formed between the patch and the primary strip.

The pager system of the present invention is a specialized pager holder. It is designed in various dimensions, depending upon the model of the pager with which it is to be used. The pager holder is manufactured from webbed nylon material. Various colors could be available. The first piece of material used to form the pager holder of the present invention is folded in half to form a loop which goes over the wearer's belt. To work effectively, the looped piece must be long enough to allow the top of the pager unit to ride below the bottom edge of the belt. This looped piece is then secured horizontally to the second portion. All seams of the pager holder would be double or triple stitched. The horizontal piece holds the pager clip. The belt loop places the pager location below the belt line, thus allowing for more comfort while bending over at the waist, or sitting while operating a vehicle, and/or stooping to do repairs at hip level. Most pagers/phone numbers cannot be read without removing them from the belt. The system of the present invention allows the pager to be lifted into view with or without removal, thereby eliminating the chances of dropping, losing, or leaving the pager behind.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A pager holder system for conveniently supporting a pager from a region suspended from a wearer's belt comprising, in combination:

a generally rectangular primary strip of a durable material with a central fold line at the upper extent to provide an exterior portion and an interior portion of substantially the same length, the lower extent of the exterior portion and the lower extent of the interior portion being sewn together by stitching along a rectangular periphery for the majority of their extents but sufficient to retain an unstitched loop in the upper region for the passage of a belt therethrough, the primary strip having a width of between about 1 and ¾ inches and 2 inches and a total length of between about 14 inches to 18 inches;

a supplemental patch of supplemental material having a width essentially equal to the width of the primary strip and a height of about one and ½ inches to about one and ¾ inches, the supplemental patch being sewn by stitching along its vertical edges coextensive with the vertical edges of the primary strip through common threads to form a vertical loop for the receipt of a pager clip, said vertical loop having an open upper edge and open lower edge; and a pager supported by the device with a spring urged clip having an arm depending downwardly through the open upper edge formed between the patch and the primary strip.

* * * * *